US009559455B2

(12) United States Patent
Bergum et al.

(10) Patent No.: US 9,559,455 B2
(45) **Date of Patent: *Jan. 31, 2017**

(54) WATER IMPERMEABLE ELECTRICAL JUNCTION SYSTEM

(71) Applicant: S.J. ELECTRO SYSTEMS, INC., Detroit Lakes, MN (US)

(72) Inventors: Alan J. Bergum, Detroit Lakes, MN (US); Alain Julian Atchia, Tarpon Springs, FL (US)

(73) Assignee: S.J. Electro Systems, Inc., Detroit Lakes, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/712,686

(22) Filed: May 14, 2015

(65) Prior Publication Data

US 2015/0333438 A1 Nov. 19, 2015

Related U.S. Application Data

(63) Continuation-in-part of application No. 14/277,937, filed on May 15, 2014.

(51) Int. Cl.
*H01R 13/52* (2006.01)
*H01R 13/523* (2006.01)
*H01R 25/00* (2006.01)

(52) U.S. Cl.
CPC ..... *H01R 13/5219* (2013.01); *H01R 13/523* (2013.01); *H01R 25/006* (2013.01)

(58) Field of Classification Search
CPC ..... H01R 13/5216; H01R 9/24; H01R 13/521; H01R 4/70; H01R 13/5208; H01R 13/5202; H01R 4/2433; H01R 13/52;H01R 13/5219; H01R 13/523; H01R 25/003
See application file for complete search history.

(56) References Cited

U.S. PATENT DOCUMENTS 4,772,231 A * 9/1988 Hayes ..... H01R 13/5221 439/272
5,580,266 A * 12/1996 Shelly ..... H01R 13/53 439/281

(Continued)

OTHER PUBLICATIONS

"Level Controls—ESPS-100, ESPS-200 and ESPS-150—Simplex, Duplex and Automatic Simplex," Barnes® Pressure Systems, Crane®, A Crane Co. Company, 2 pages.

(Continued)

*Primary Examiner* — Xuong Chung Trans
(74) *Attorney, Agent, or Firm* — Dicke, Billig & Czaja, PLLC

(57) ABSTRACT

A water impermeable electrical junction system for effectively preventing a contaminant such as liquid, water, and debris from contacting electrical connections. The water impermeable electrical junction system generally includes a base, a first seal member connected to the base, a first connector positioned within the first seal member, a second seal member configured and arranged to operatively connect to the first seal member, and a second connector positioned within the second seal member. The first connector and the second connector electrically connect to one another with the first seal member and second seal member covering the first connector and second connector to prevent the entry of a contaminant inside of the seal members or to make contact with the connectors.

26 Claims, 17 Drawing Sheets

(56) References Cited

U.S. PATENT DOCUMENTS

| | | | | |
|---|---|---|---|---|
| 6,429,373 | B1 * | 8/2002 | Scrimpshire | H02G 15/013 174/74 A |
| 6,462,666 | B1 * | 10/2002 | Einck | C02F 3/006 340/618 |
| 7,578,657 | B2 | 8/2009 | Kowalak et al. | |
| 8,002,565 | B2 * | 8/2011 | Bogart | H01R 13/5202 439/281 |
| 8,480,428 | B1 * | 7/2013 | Sper | H01R 13/5213 439/521 |

OTHER PUBLICATIONS

"Barnes Pressure Sewer ESPS Series," Barnes® Pressure Systems, Crane®, A Crane Co. Company, 2 pages (© 2012 Crane Pumps & Systems, Inc.).

"IP68 Mini Buccaneer® Water Tight Connectors," Bulgin, 4 pages.

"IP68 Mini Buccaneer® Waterproof Electrical Connectors," Bulgin, 3 pages, http://www.bulgin.co.uk/Products/Buccaneer/BuccaneerMini.html.

Amphenol Sine Systems A Series™ and AT Series™ Connectors, Catalog No. ASC2013, 36 pages, Rev. Jan. 2014.

"Orenco®—General Onsite Wastewater Products," 2014 Catalog, cover page and pp. 51-52 (Orenco Systems®, Incorporated).

"Briggs & Stratton 691909 Spark Plug Boot Replacement for Models 280872 and 691909," 1 page, http://www.amazon.com/Briggs-Stratton-691909-Replacement-Models/dp/B002WO2AI2/ref=sr_1_1?ie=UTF8&qid=1427299807&sr=8-1&keywords=briggs+and+stratton+691909+spark+plug.

* cited by examiner

WATER IMPERMEABLE ELECTRICAL JUNCTION SYSTEM

CROSS REFERENCE TO RELATED APPLICATIONS

This application is a continuation-in-part application of U.S. patent application Ser. No. 14/277,937 filed May 15, 2014.

STATEMENT REGARDING FEDERALLY SPONSORED RESEARCH OR DEVELOPMENT

Not applicable to this application.

BACKGROUND OF THE INVENTION

Field of the Invention

The present invention relates generally to an electrical junction and more specifically it relates to a water impermeable electrical junction system for effectively preventing water and debris from contacting electrical connections.

Description of the Related Art

Any discussion of the related art throughout the specification should in no way be considered as an admission that such related art is widely known or forms part of common general knowledge in the field.

It is important when working in water related environments (e.g. septic tanks) that electrical connections are completely sealed from water and other debris (e.g. toilet paper in the fluid). Electronic devices such as floats and sensors need to be electrically connected to a control panel which is typically done through a junction box positioned above the water line in the septic tank. While conventional junction boxes are positioned above the fluid level in the tank in an attempt to prevent the electrical connections from being contaminated with water, they are still prone to splashing or accidental rising of fluid level in the tank thereby exposing the electrical connections to water. Over time, even sealed electrical connections will degrade and become increasingly susceptible to random contact with contaminants such as liquids and debris in the tank thereby resulting in an electrical short or corrosion.

Because of the inherent problems with the related art, there is a need for a new and improved water impermeable electrical junction system for effectively preventing water and debris from contacting electrical connections.

BRIEF SUMMARY OF THE INVENTION

The invention generally relates to an electrical junction that includes a base, a first seal member connected to the base, a first connector positioned within the first seal member, a second seal member that physically connects to the first seal member, and a second connector positioned within the second seal member. The first connector and the second connector electrically connect to one another with the first seal member and the second seal member covering the first connector and the second connector to prevent the entry of contaminants such as liquids and debris inside of the seal members or to make contact with the connectors.

It is recognized that at least one seal assembly comprising mating first and second seal members and at least one connector assembly comprising mating first and second connectors could be used.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
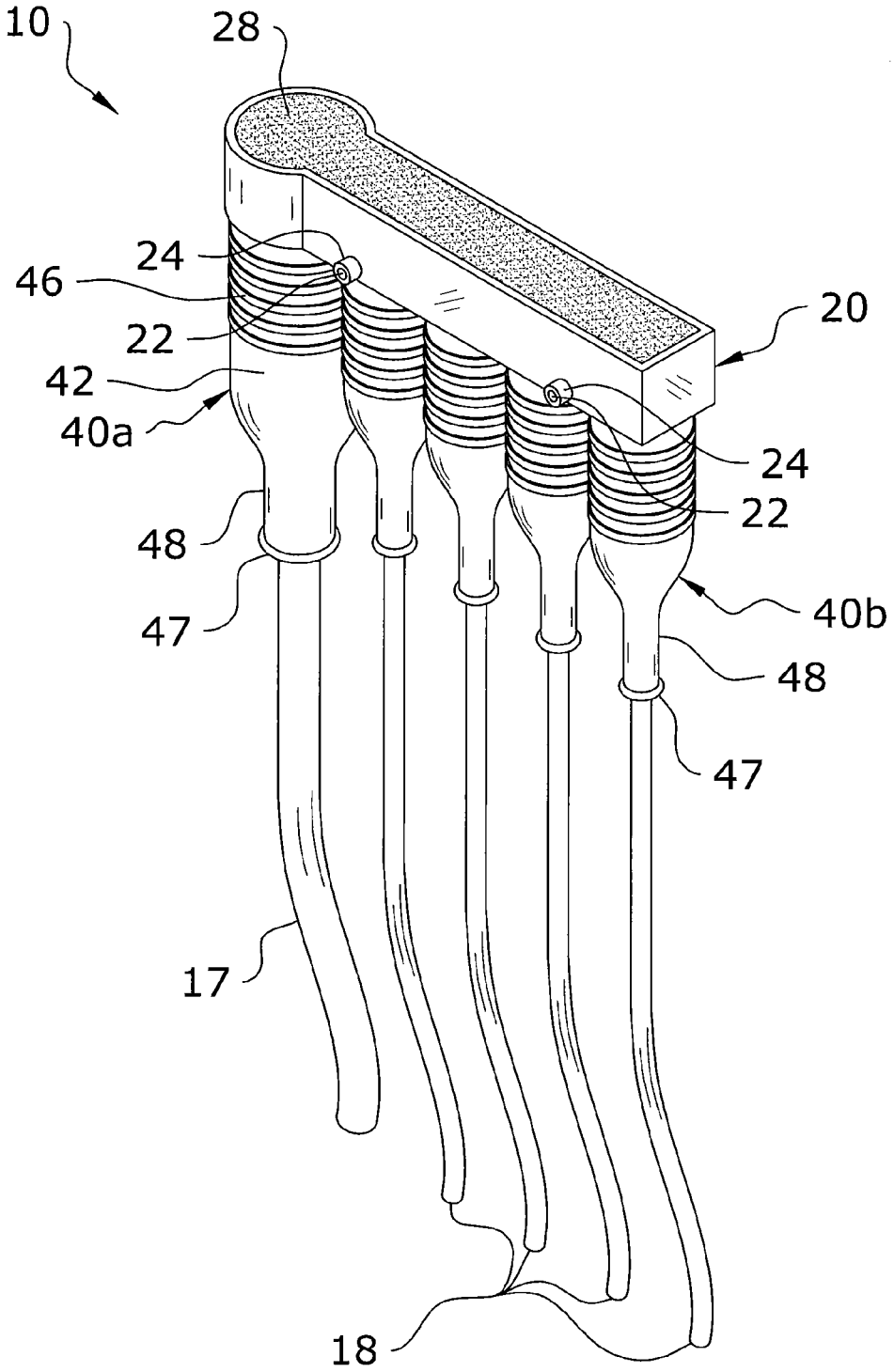
FIG. 1 is an upper perspective view of an embodiment of the present invention.

Turning now descriptively to the drawings, in which similar reference characters denote similar elements throughout the several views, generally FIGS. 1 through 11 illustrate an embodiment water impermeable electrical junction system 10, which comprises a base 20, at least one first seal members 30 connected to the base 20, at least one first connectors 14 positioned within the first seal members 30, at least one second seal members 40 that physically connect to the first seal members 30, and at least one second connectors 16 positioned within the second seal members 40. The first connectors 14 and the second connectors 16 electrically connect to one another with the first seal members 30 and second seal members 40 covering the first connectors 14 and second connectors 16 to prevent the entry of contaminants such as liquids and debris inside of the seal members 30, 40 or to make contact with the connectors 14, 16. Generally FIGS. 12 through 16 illustrate another embodiment water impermeable electrical junction system 110, which comprises a base 120, a first seal member 130 connected to the base 120, a first connector 114 positioned within the first seal member 130, a second seal member 140 that physically connects to the first seal member 130, and a second connector 116 positioned within the second seal member 140. The first connector 114 and the second connector 116 electrically connect to one another with the first seal member 130 and second seal member 140 covering the first connector 114 and second connector 116 to prevent the entry of contaminants such as liquids and debris inside of the seal members 130, 140 or to make contact with the connectors 114, 116.

More specifically, FIGS. 1 through 8 illustrate an embodiment water impermeable electrical junction system 10. This embodiment includes a base 20 that is preferably comprised of an elongated structure to accommodate a plurality of first connectors and first seal members. The length of the base 20 may vary depending upon the number and size of the first connectors and first seal members used with the base 20. Although several first connectors and first seal members are shown, it is recognized that one or more first connectors and first seal members could be used.

The base 20 has a channel or recessed portion within the upper portion to receive the connector wires 15 that connect the primary first connector 14*a* to the secondary first connectors 14*b*. The channel or recessed portion is preferably filled with a resin 28 or other sealing material to protect the connector wires 15 and the first connectors that are attached to the base 20 and/or first seal members as illustrated in FIGS. 1, 2*a*, 7 and 8 of the drawings.

Figure 2A:
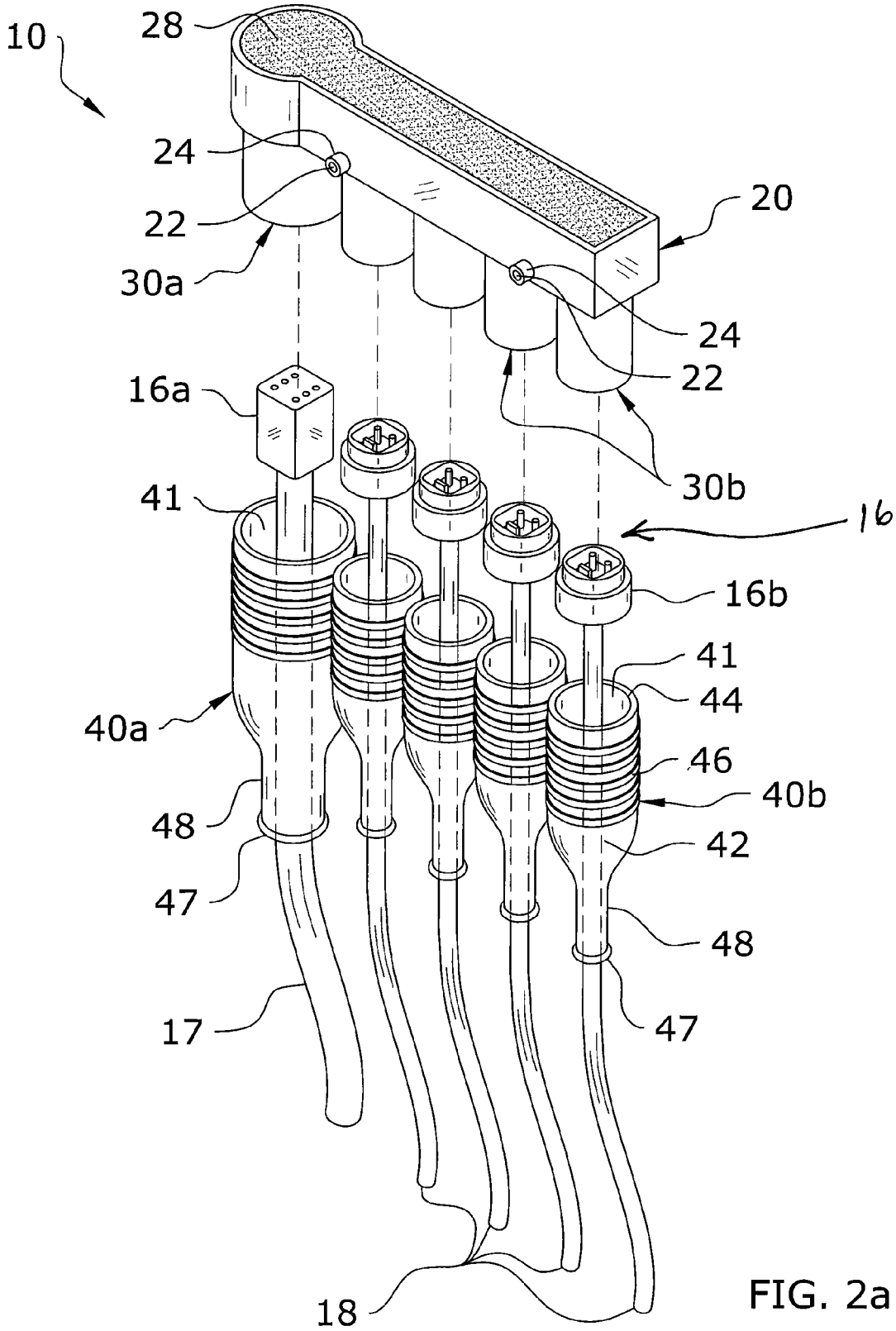
FIG. 2*a* is an exploded upper perspective view of the embodiment shown in FIG. 1.
Figure 8:
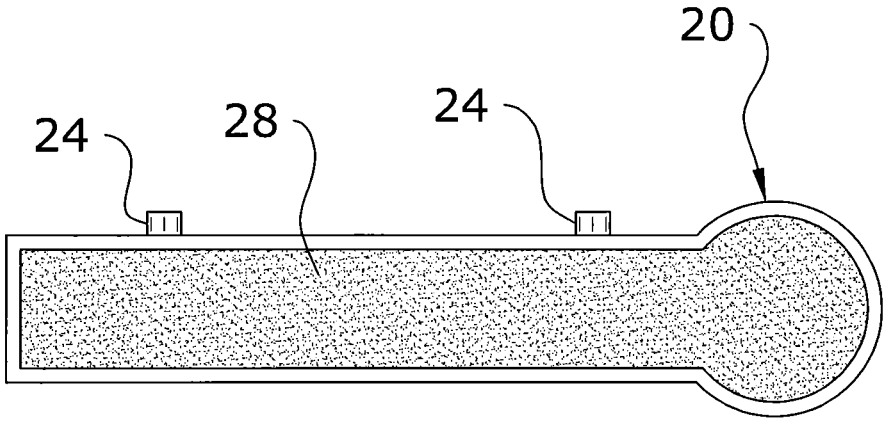
FIG. 8 is a top view of the embodiment shown in FIG. 1.

The base 20 preferably has a rectangular cross sectional shape for a significant length of the base 20 with an end portion wider in the shape of the first connector as illustrated in FIGS. 1, 2*a* and 8 of the drawings. For example, the top view of FIG. 8 illustrates the base 20 having a generally rectangular shape with a rounded end portion for the primary first connector 14*a*.

Figure 9A:
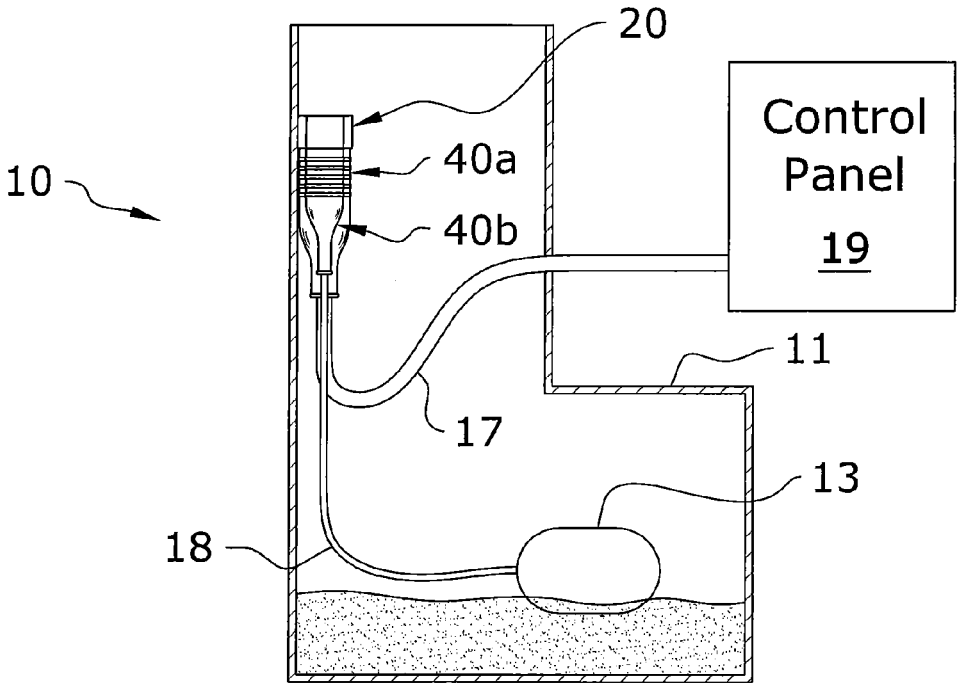
FIG. 9*a* is a side view of the embodiment shown in FIG. 1 mounted within the interior of a liquid tank and electrically connected between an electronic device and a control panel.

The base 20 preferably includes at least one mounting aperture 22 adapted to receive a corresponding fastener 12 to secure the base 20 to an interior or exterior wall of a liquid tank 11 such as a septic tank 11 as illustrated in FIG. 9*a* of the drawings. It is further preferable that there are at least two mounting apertures 22 extending through the base 20 to provide for stable mounting of the base 20 to the interior sidewall of the liquid tank 11. For each of the mounting apertures 22, a corresponding spacer 24 extends outwardly from a sidewall of the base 20 with the mounting aperture 22 extending concentrically through to provide spacing between the narrower portion of the base 20 from the sidewall of the liquid tank 11.

Connectors 14, 16 may be comprised of any type of electrical connector including but not limited to female/male electrical connectors, soldered wires connected to one another or to electrical contacts, wires directly connected to one another and the like. The connectors 14, 16 may be comprised of any device or system capable of electrically connecting the connector wires 15 within the base 20 to the respective cables 17, 18. The connectors 14, 16 may allow for the electrical connection of 2, 3, 4, 5 or more wires as needed for the type of application, the number of electronic devices 13 and the type of control panel 19. The connectors 14, 16 may be male connectors or female connectors or a mixture of the same. The connectors 14, 16 are preferably comprised of a structure that prevents the entry of contaminants such as liquids and debris into the electrical contacts of the connectors 14, 16 when the connectors 14, 16 are connected to one another including connectors 14, 16 with seals around their respective perimeters.

Figure 4:
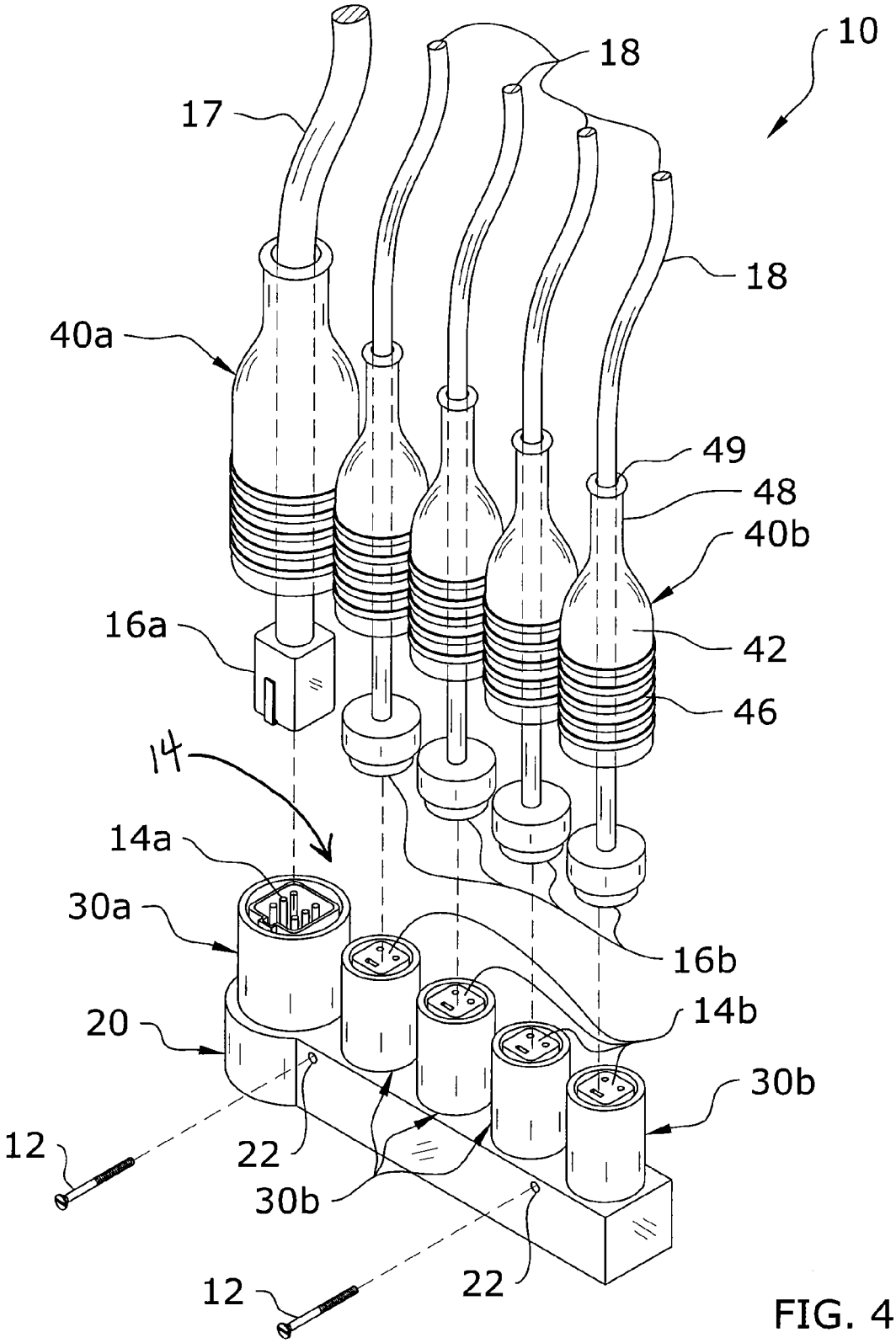
FIG. 4 is an exploded upper perspective view of the embodiment shown in FIG. 1 inverted.
Figure 7:
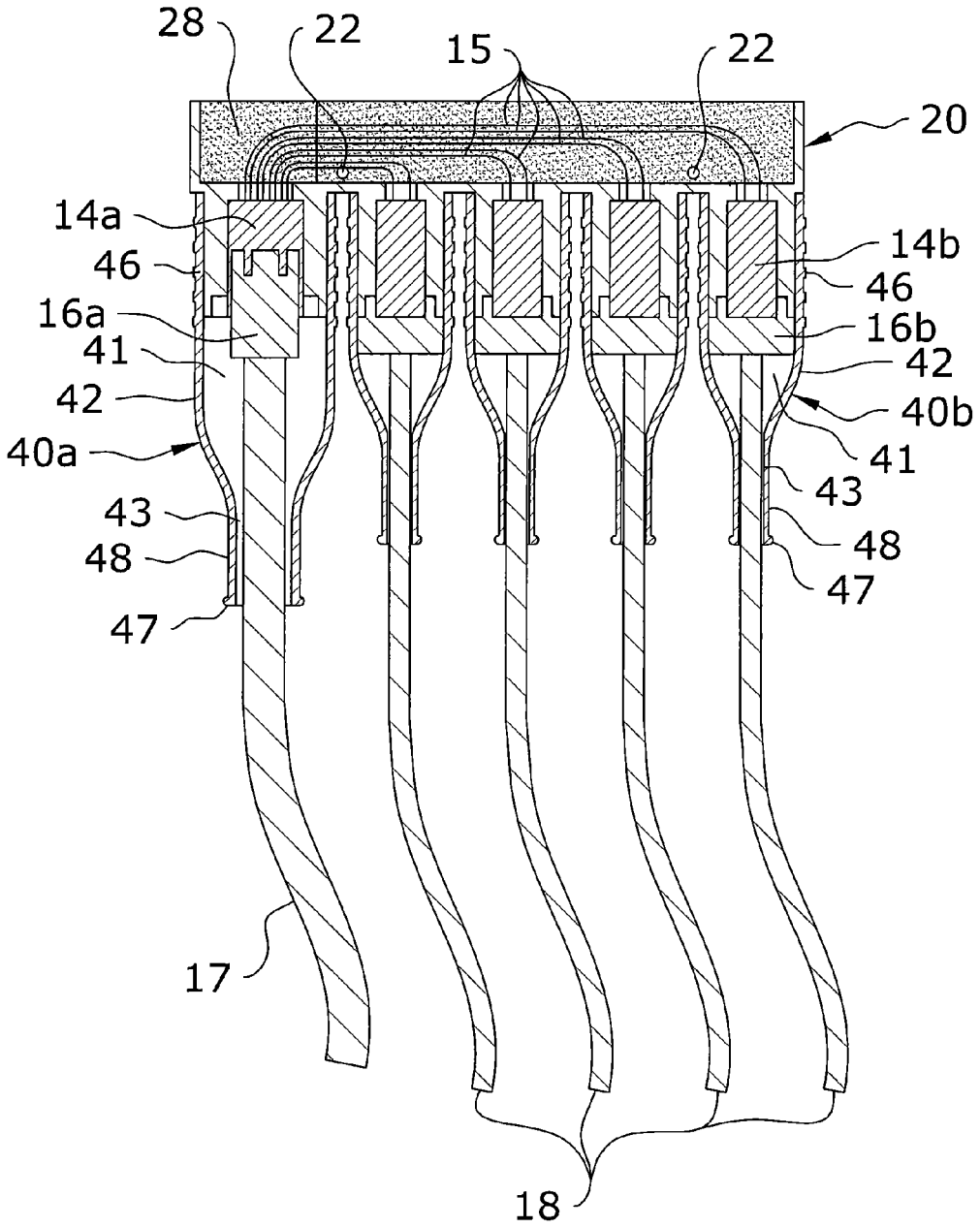
FIG. 7 is a cross sectional view taken along line 7-7 of FIG. 6.

The plurality of first connectors 14 each are respectively positioned within the first seal members 30 and extend downwardly from the base 20 as illustrated in FIGS. 4 and 7 of the drawings. The first connectors 14 may be recessed, flush or extended outwardly from the bottom edge of the first seal members 30. The plurality of first connectors 14 may be directly attached to the first seal members 30 or attached to the base 20 with the first seal members 30 surrounding the first connectors 14.

The plurality of first connectors 14 are comprised of a primary first connector 14*a* and at least one secondary first connector 14*b*. As shown in FIGS. 2*a* and 7, there are preferably a plurality of secondary first connectors 14*b*. The primary first connector 14*a* is electrically connected to at least one of the secondary first connectors 14*b*. The primary first connector 14*a* is preferably electrically connected to all of the secondary first connectors 14*b*. The primary first connector 14*a* is illustrated as a male connector and the secondary first connectors 14*b* are illustrated as female connectors, however, it can be appreciated that the first connectors 14 may be comprised of any type of electrical connector including but not limited to male or female connectors.

The plurality of second connectors 16 are positioned within the second seal members 40 as illustrated in Figures a2 and 7 of the drawings. The plurality of second connectors 16 are each respectively electrically connectable to the plurality of first connectors 14. The second connectors 16 may be recessed, flush or extended outwardly from the upper edge of the second seal members 40. It is preferable that the second connectors 16 are longitudinally movably positioned within the second seal members 40 for allowing extension upwardly from the second seal members 40 to allow for connection of the second connectors 16 to the first connectors 14 before positioning the second seal members 40 upon the first seal members 30. The second connectors 16 may be directly attached to the second seal members 40, but are preferably not directly attached to the second seal members 40 as illustrated in FIG. 4 of the drawings. The primary second connector 16*a* is illustrated as a female male connector that plugs into the primary first connector 14*a* and the secondary second connectors 16*b* are illustrated as male connectors that plug into the secondary first connectors 14*b*, however, it can be appreciated that the second connectors 16 may be comprised of any type of electrical connector including but not limited to male or female connectors.

Figure 9B:
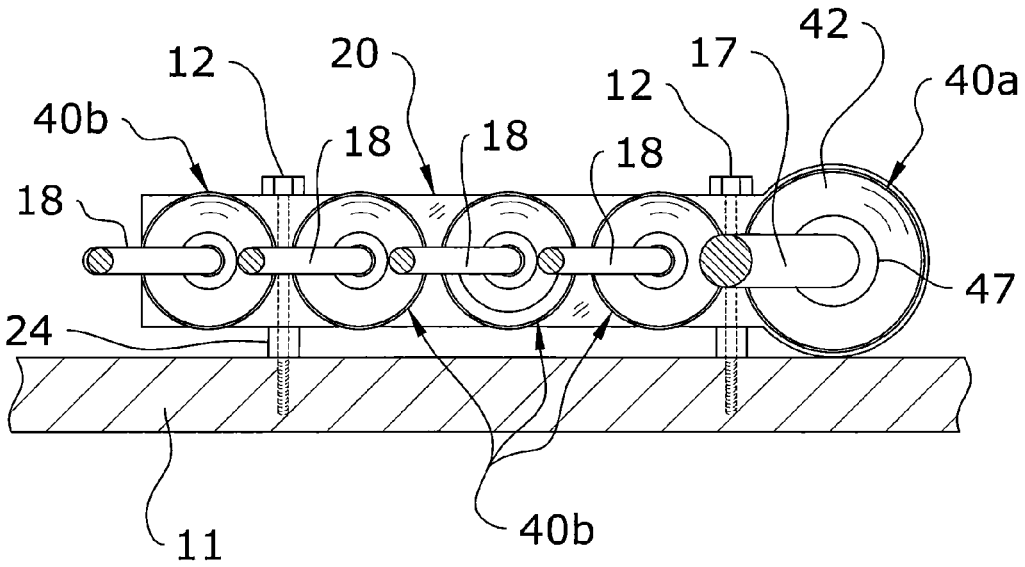
FIG. 9*b* is a bottom view of the embodiment shown in FIG. 1 attached to a wall of the liquid tank.

The secondary first connectors 14*b* are each electrically connected to an electronic device 13 by a corresponding plurality of secondary cables 18 such as but not limited to a float switch, temperature sensor and other types of devices used in tanks 11. The primary second connector 16*a* is electrically connected to a control panel 19 thereby providing the electrical data communications from the electronic devices 13 electrically connected to the secondary second connectors 16*b* as illustrated in FIG. 9*b* of the drawings. The control panel 19 may also transmit data, instructions and commands to the electronic devices 13 via the corresponding primary cable 17 and the secondary cables 18. The control panel 19 is positioned externally of the tank 11 as further illustrated in FIG. 9*a* of the drawings.

As illustrated in FIGS. 2*a* and 4 of the drawings, a plurality of first seal members 30 are connected to the base 20. The first seal members 30 may be attached or integrally formed with the base 20 as a unitary structure. The plurality of first seal members 30 preferably extend downwardly from a bottom surface of the base 20 to further protect the first connectors 14 and the second connectors 16 since gravity will pull any contaminants such as liquids and debris that get between the seal members 30, 40 downwardly away from the connectors 14, 16.

The first seal members 30 are preferably comprised of a tubular structure that surrounds the first connectors 14. The first seal members 30 preferably have a circular cross sectional shape as illustrated in FIG. 4 of the drawings, however, the first seal members 30 may have various other cross sectional shapes such as but not limited to rectangular. The first seal members 30 each have a lower opening that exposes the corresponding first connector 14 within the first seal members 30.

The plurality of second seal members 40 physically connect to the first seal members 30 to prevent the entry of contaminants such as liquids and debris to the plurality of first connectors 14 and second connectors 16 when the connectors 14, 16 are connected to one another. The second seal members 40 are formed into a shape that mates with the first seal members 30 to prevent the entry of contaminants such as liquids and debris from making contact with the connectors 14, 16 when positioned within a wet environment such as within a septic tank 11. The first seal members 30 and the second seal members 40 each cover and/or seal a respective pair of connectors 14, 16 to protect the connectors 14, 16 from contaminants such as liquids and debris.

The first seal members 30 and the plurality of second seal members 40 preferably overlap one another to form a protective seal that prevents contaminants such as liquids and debris from entering the connectors 14, 16. It is preferably that the plurality of second seal members 40 overlap the plurality of first seal members 30 as illustrated in FIGS. 1, 3, 5, 6 and 7 of the drawings. The plurality of second seal members 40 preferably overlap an entire portion of the plurality of first seal members 30.

The second seal members 40 are each comprised of a tubular structure having a first opening 44 in a first end that fits over the plurality of first seal members 30. Alternatively, the first seal members 30 can be sized larger than the second seal members 40 to fit over the second seal members 40. The second seal members 40 also each have a second opening 49 in a second end that receives a cable 17, 18. The second end of the second seal members 40 is opposite of the first end, with the first opening 44 preferably concentrically aligned with the second opening 49 of the second seal members 40.

Figure 11:
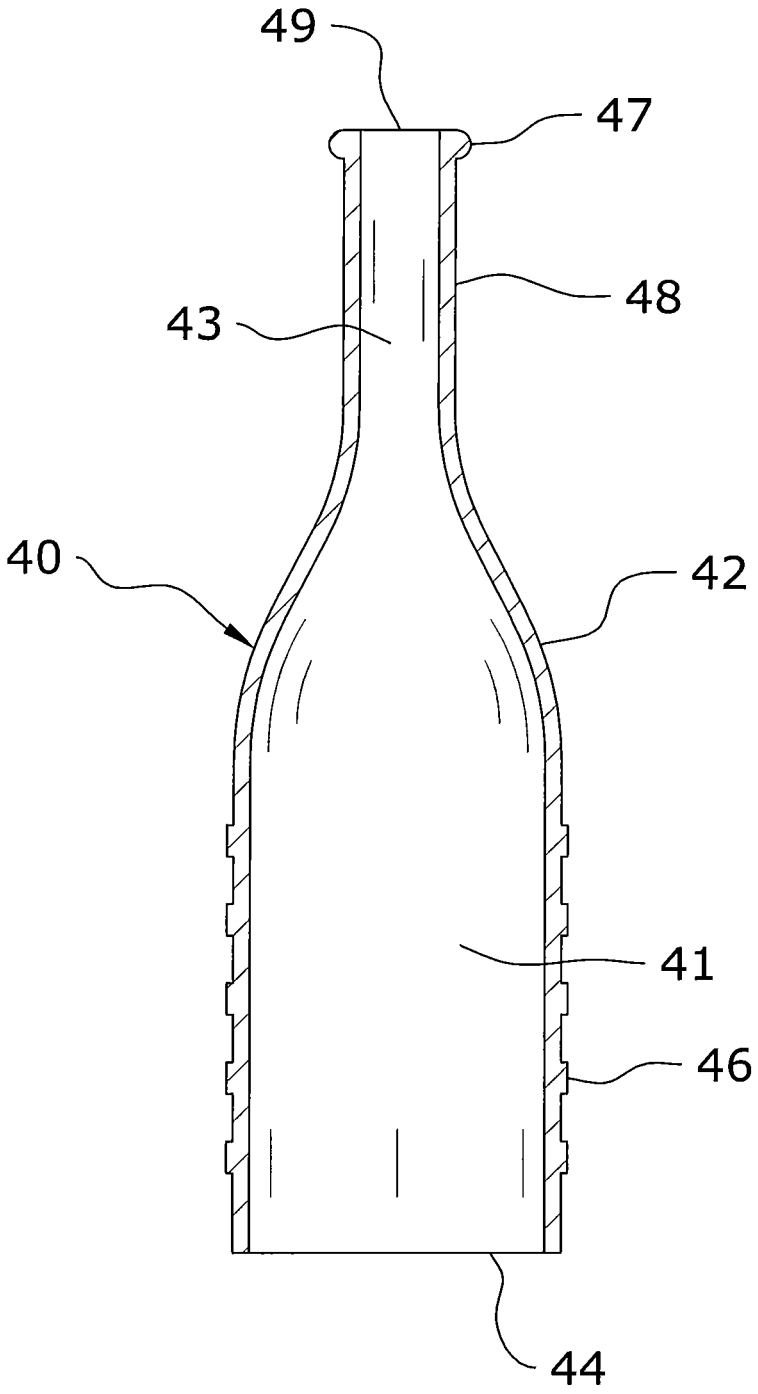
FIG. 11 is a cross sectional view taken along line 11-11 of FIG. 10.

The second seal members 40 are preferably comprised of a resilient and flexible material that allows for a snug fit over the first seal members 30. The second seal members are preferably comprised of a first portion 42 encompassing the first opening 44 and a second portion 48 encompassing the second opening 49, wherein the second portion 48 is narrower than the first portion 42. The first portion 42 has a first interior portion 41 that is large enough to receive the outer surface of the first seal members 30 as illustrated in FIGS. 2 and 7 of the drawings. The first interior portion 41 has an interior surface that is preferably comprised of a constant diameter that is approximately the same as the outer diameter of the first seal members 30 as illustrated in FIG. 11 of the drawings. The second portion 48 of the second seal members 40 includes a flanged portion 47 surrounding the second opening 49 as shown in FIGS. 1 through 7 of the drawings. The second opening 49 for each of the plurality of second seal members is adapted to allow the cable 17, 18 positioned within the second opening 49 to slide longitudinally within the second opening 49 while having an interior diameter sufficient to provide a liquid tight seal against the entry of contaminants such as liquids and debris into the interior of the second seal members 40.

Figure 10:
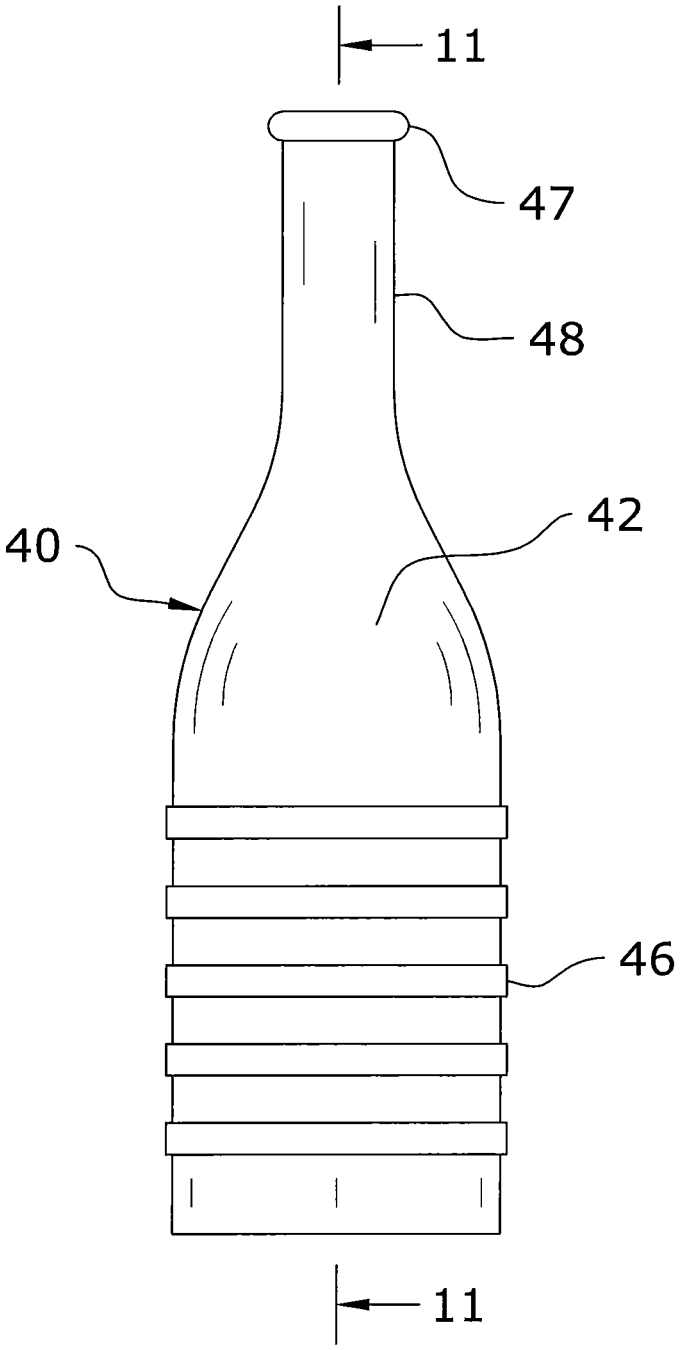
FIG. 10 is a side view of a second seal member of the embodiment shown in FIG. 1

The second seal members 40 are preferably comprised of a primary second seal member 40*a* that connects to the primary first seal member 30*a* and at least one secondary second seal member 40*b* that connects to the secondary second seal members 40*b* as shown in FIGS. 1 through 5 of the drawings. The primary second seal member 40*a* is preferably comprised of a larger size than the secondary second seal members 40*b* since there are a larger number of wires connected to the primary second connector 16*a*. In particular, all of the secondary cables 18 are electrically connected to the primary cable 17 within the primary second seal member 40*a* via the connectors 14, 16 along with the connector wires 15 in the base 20 as illustrated in FIG. 7 of the drawings. The second seal members 40 further preferably include a gripping 46 within the exterior of the first portion 42 to assist in manipulation by the user such as but not limited to a plurality of raised rings as illustrated in FIGS. 10 and 11 of the drawings.

Figure 2B:
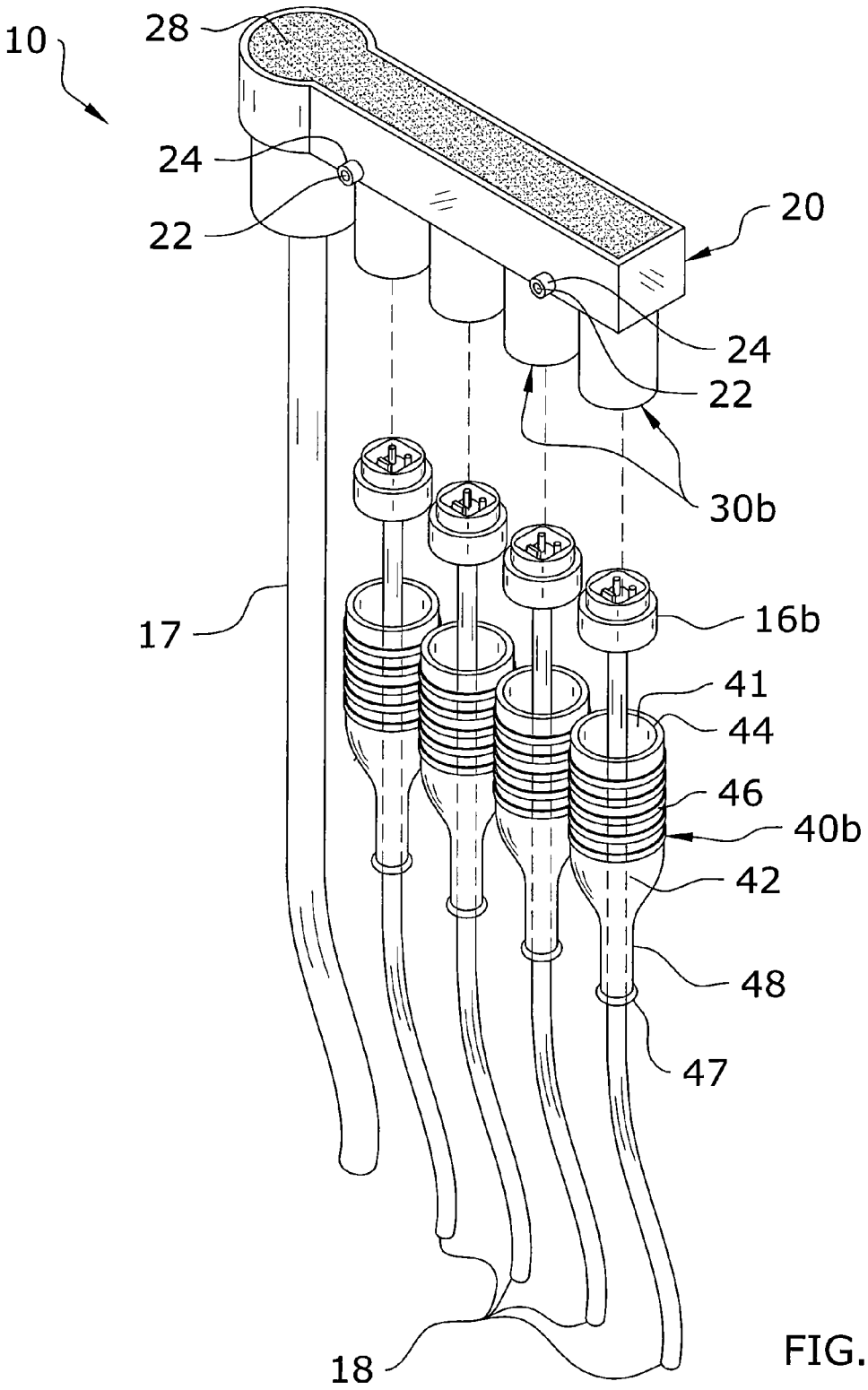
FIG. 2*b* is an exploded upper perspective view of an alternative embodiment of that shown in FIG. 1 wherein the primary cable is directly connected to the base.
Figure 3:
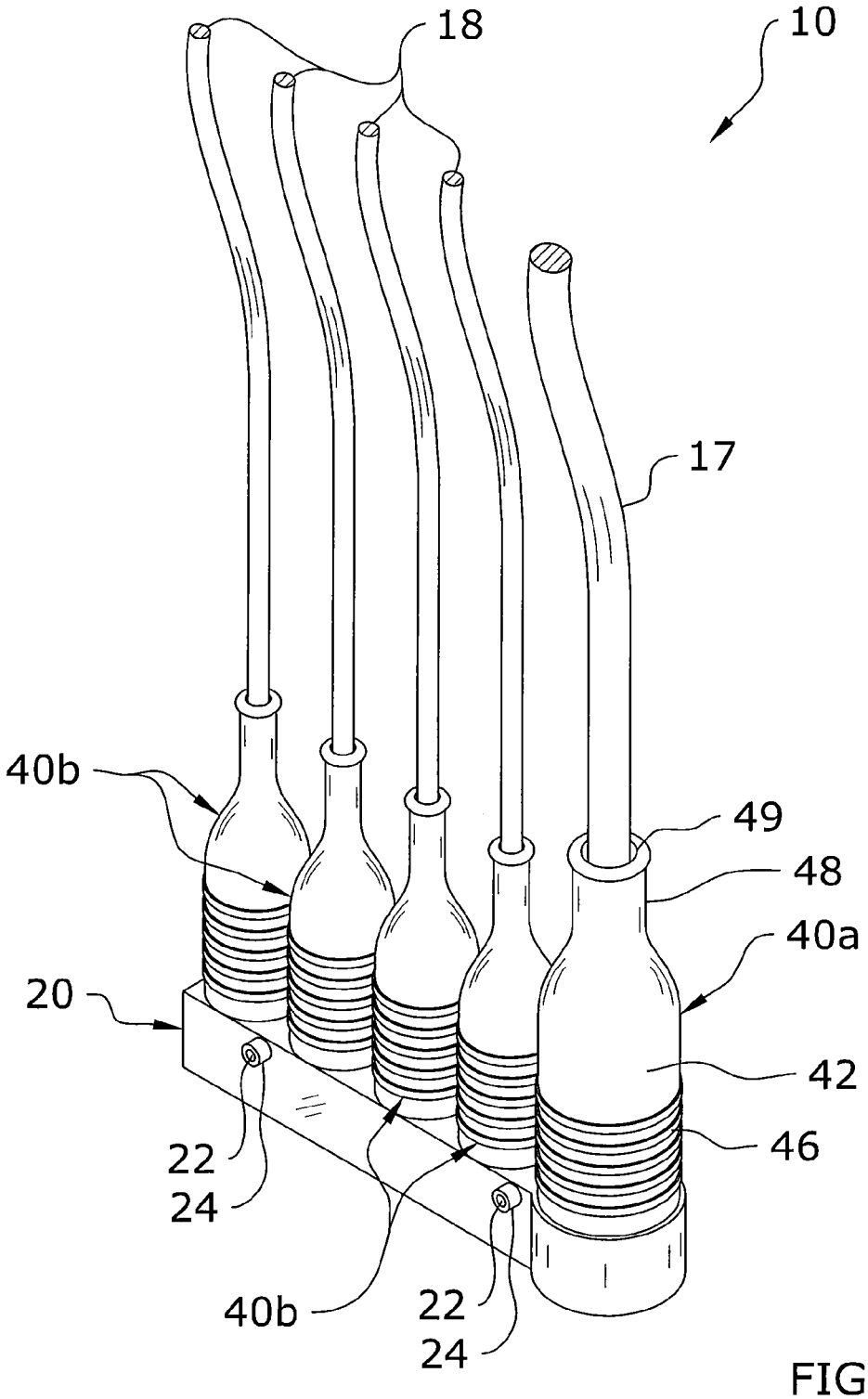
FIG. 3 is an upper perspective view of the embodiment shown in FIG. 1 inverted.

FIG. 2*b* is an exploded upper perspective view of an alternative embodiment wherein the primary cable 17 is directly connected to the base 20 without using a removable connector. In the alternative embodiment shown in FIG. 2*b*, it is further preferable that the primary cable 17 is potted directly within the resin 28 of the base. The primary cable 17 is electrically and directly connected to the secondary cables 18.

Figure 5:
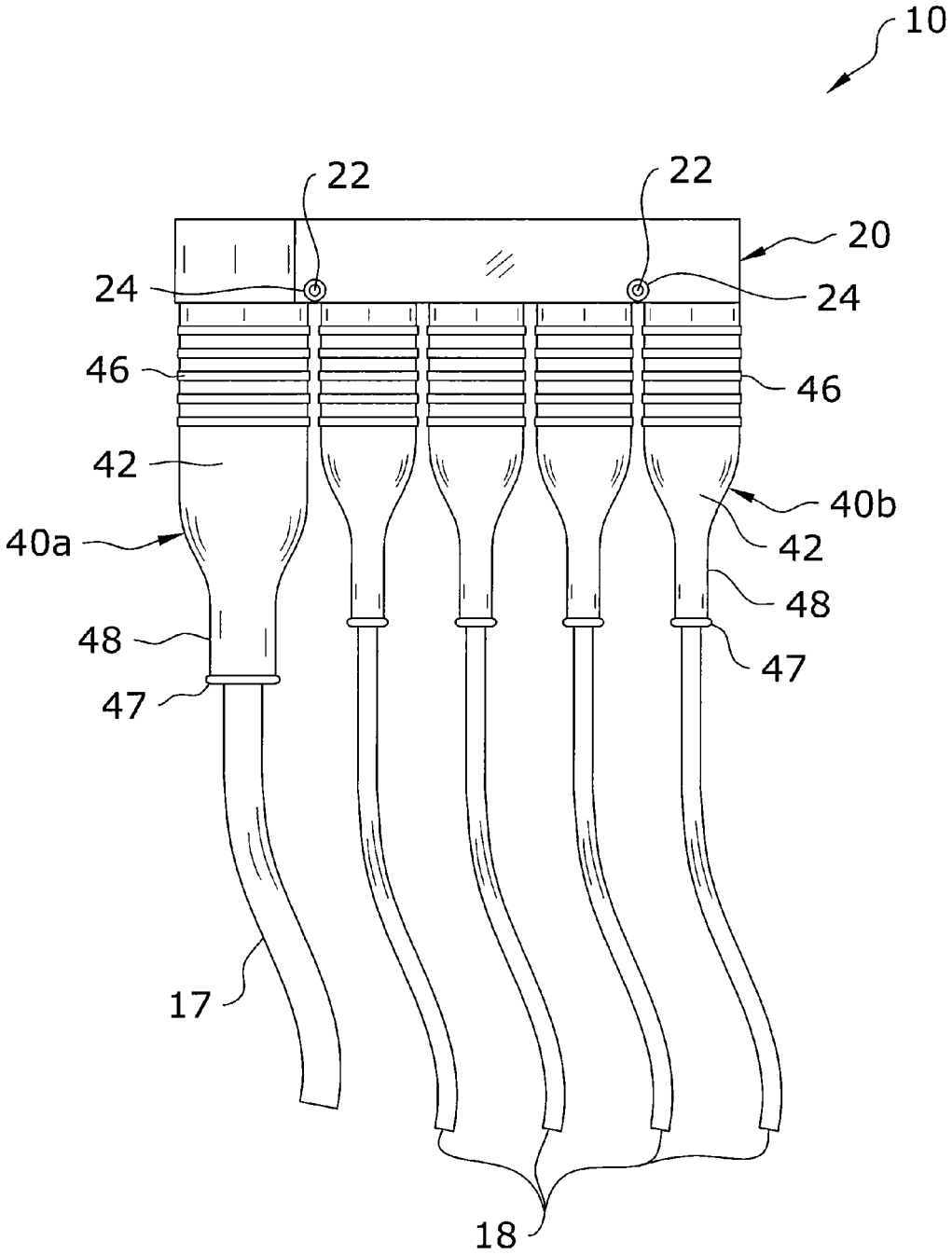
FIG. 5 is a front view of the embodiment shown in FIG. 1.
Figure 6:
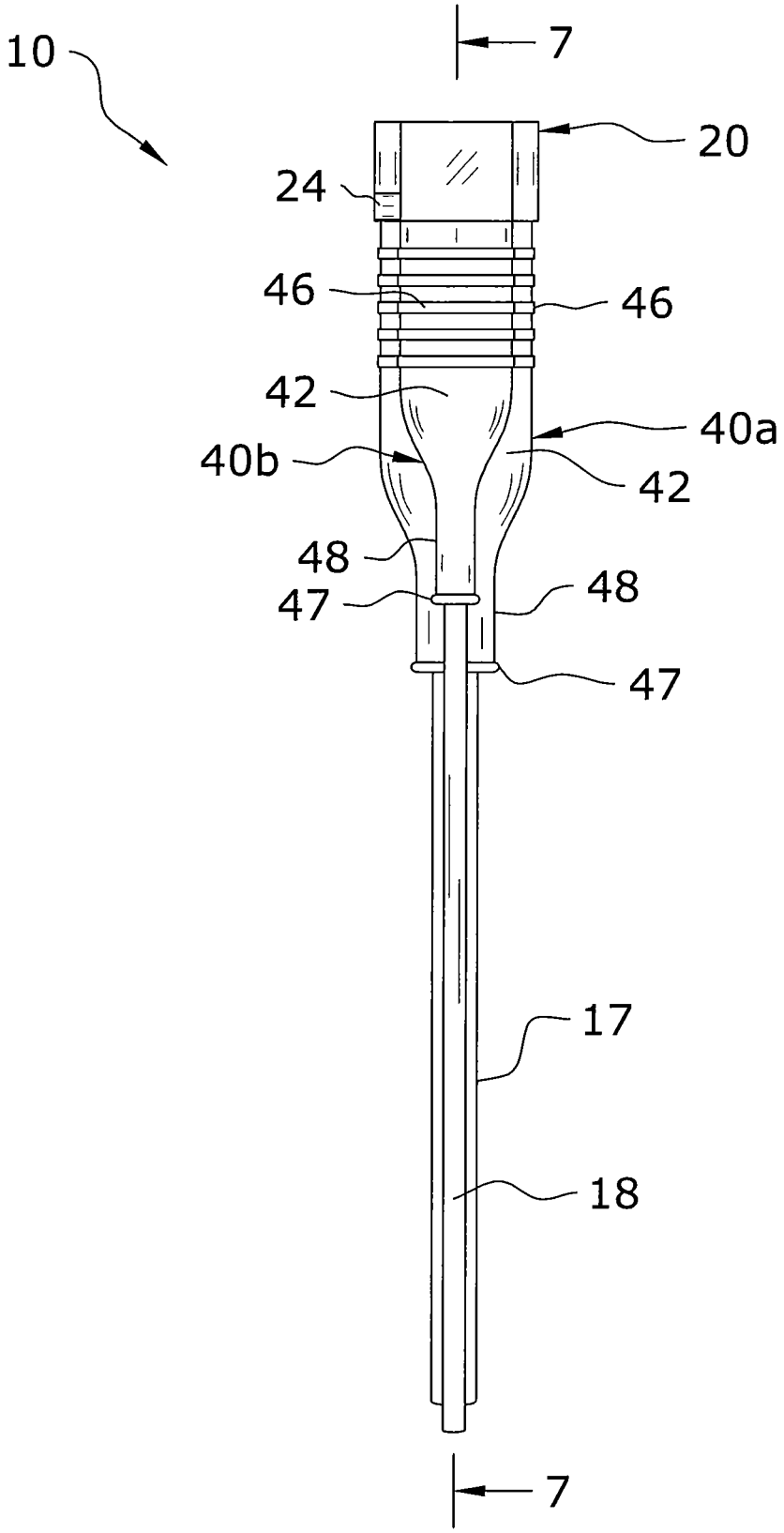
FIG. 6 is a side view of the embodiment shown in FIG. 1.

In use, the user mounts the control panel 19 externally of the tank 11 in a desired location and then secures the base 20 to the wall of the tank 11 above the highest possible liquid level within the tank 11. The user then electrically connects the primary cable 17 from the control panel 19 by connecting the primary second connector 16*a* with the primary first connector 14*a*. The user then slides the primary second seal member 40*a* upwardly along the primary cable 17 and then onto the primary first seal member 30*a* until snugly and frictionally retained upon the primary first seal member 30*a* as illustrated in FIGS. 1, 5 and 7 of the drawings. The user then electrically connects the secondary cables 18 for each of the electronic devices 13 by connecting each secondary second connector 16*b* with the corresponding secondary first connector 14*b*. The user then slides the secondary second seal member 40*b* upwardly along the corresponding secondary cable 18 and then onto the secondary first seal member 30*b* until snugly and frictionally retained upon the secondary first seal member 30*b* as illustrated in FIGS. 1, 5 and 7 of the drawings. Once all of the connectors 14, 16 are connected and their corresponding seal members 30, 40 connected together in a liquid sealed or semi-sealed manner, the user may then operate the tank 11 by allowing liquid such as water to enter the tank 11. The electronic devices 13 provide data to the control panel 19 via the secondary cables 18 and then to the control panel 19 by the primary cable 17. Contaminants such as water, other liquids, and debris that engage the second seal members 40 are deflected and allowed to freely fall off. Any liquid that should enter between the seal members 30, 40 is allowed to flow downwardly without contacting the connectors 14, 16. The second seal members 40 in particular deflect debris such as toilet paper to prevent the same from attaching to the connectors 14, 16 which can over time reduce the water tight seal the connectors 14, 16 have created with respect to one another after connection thereby extending the useful life of the connectors 14, 16.

More specifically, FIGS. 12 through 16 illustrate another embodiment water impermeable electrical junction system 110. Although the base 120 is shown as being generally rectangular in shape, it is recognized that it could be any suitable shape and size. The base 120 is a sealed potted area where connection of the cables 118*a* can be made to each other and to connector 114. A housing 125 receives connector 116, and housing 125 can be potted and provide additional strain relieve to cable 117. A housing stop 125*a* could be a feature of the housing 125 that allows the user to push the connectors 114, 116 together. This feature could also be used as a confirmation that the connectors 114, 116 are properly pushed together. The base 120 and the housing 125 assist in providing strain relief for the connectors 114, 116 and a place to pot the cables 117*a*, 118*a*. The base 120 could be mounted to an interior or exterior wall of a liquid tank such as a septic tank by a mounting feature 120*a*, which mates with a mounting bracket 122, which allows for mounting to the tank. The mounting feature 120*a* includes a cavity configured and arranged to receive a hook portion of the mounting bracket 122, which includes apertures 122*a* through which fasteners such as screws connect the mounting bracket 122 to the tank. It is recognized that other types of mounting members could be used.

Connectors 114, 116 may be comprised of any type of electrical connector including but not limited to female/male electrical connectors, soldered wires connected to one another or to electrical contacts, wires directly connected to one another and the like. The connectors 114, 116 may be comprised of any device or system capable of electrically connecting the base 120 and cable 118 to the respective cable 117. The connectors 114, 116 may be configured and arranged to allow for the electrical connection of 2 or more wires as needed for the type of application, the number of electronic devices and the type of control panel. The connectors 114, 116 may be male connectors or female connectors or a mixture of the same. The connectors 114, 116 are preferably comprised of a structure that prevents the entry of contaminants such as liquids and debris into the electrical contacts of the connectors 114, 116 when the connectors 114, 116 are connected to one another including seals around their respective perimeters.

Figure 13:
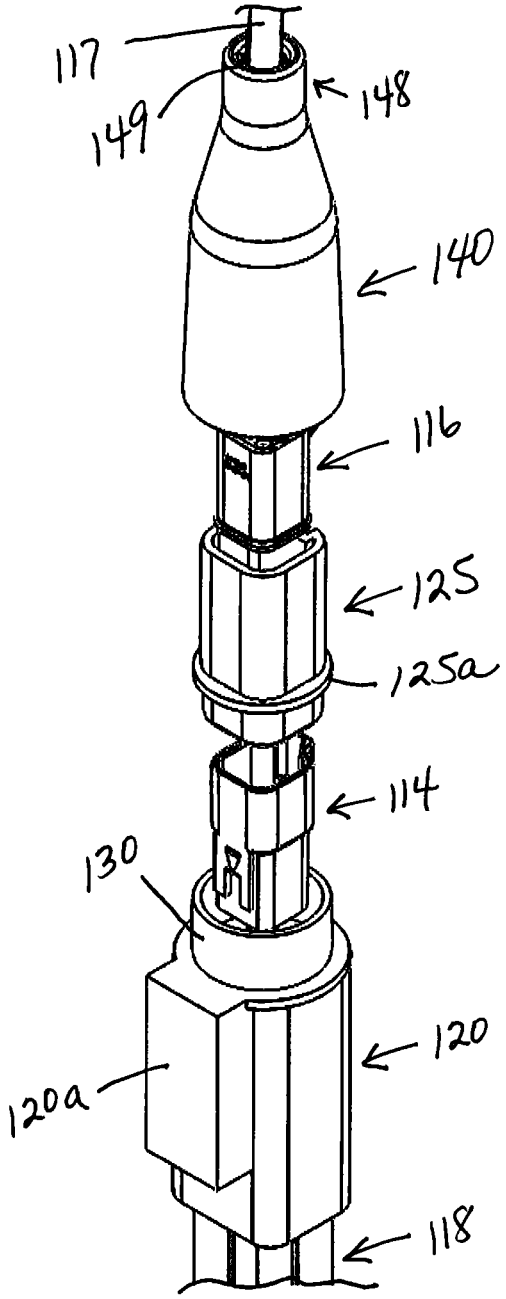
FIG. 13 is an exploded upper perspective view of the embodiment shown in FIG. 12.

In the orientation shown in the drawings, the first connector 114 is respectively positioned within a first seal member 130 and extends upwardly from the base 120 as illustrated in FIG. 13 of the drawings. The first connector 114 may be recessed, flush or extended outwardly from the bottom edge of the first seal member 130. The first connector 114 may be directly attached to the first seal member 130 or attached to the base 120 with the first seal member 130 surrounding the first connector 114. The first connector 114 may be comprised of any type of electrical connector including but not limited to male or female connectors.

In the orientation shown in the drawings, the second connector 116 is positioned within a second seal member 140 as illustrated in FIG. 13 of the drawings. The second connector 116 is electrically connectable to the first connector 114. The second connector 116 may be recessed, flush or extended outwardly from the upper edge of the second seal member 140. It is preferable that the second connector 116 is longitudinally movably positioned within the second seal member 140 for allowing extension downwardly from the second seal member 140 to allow for connection of the second connector 116 to the first connector 114 before positioning the second seal member 140 upon the first seal member 130. The second seal member 140 receives the housing 125, which receives the second connector 116. The second connector 116 may be comprised of any type of electrical connector including but not limited to male or female connectors.

The first connector 114 is electrically connected to an electronic device by a corresponding plurality of cables 118*a*, 118 such as but not limited to a float switch, temperature sensor and other types of devices used in tanks. The second connector 116 is electrically connected to a control panel thereby providing the electrical data communications from the electronic devices electrically connected to the second connector 116. The control panel may also transmit data, instructions and commands to the electronic devices via the corresponding cable 117, 117*a* and the cables 118. The control panel is positioned externally of the tank.

Figure 15:
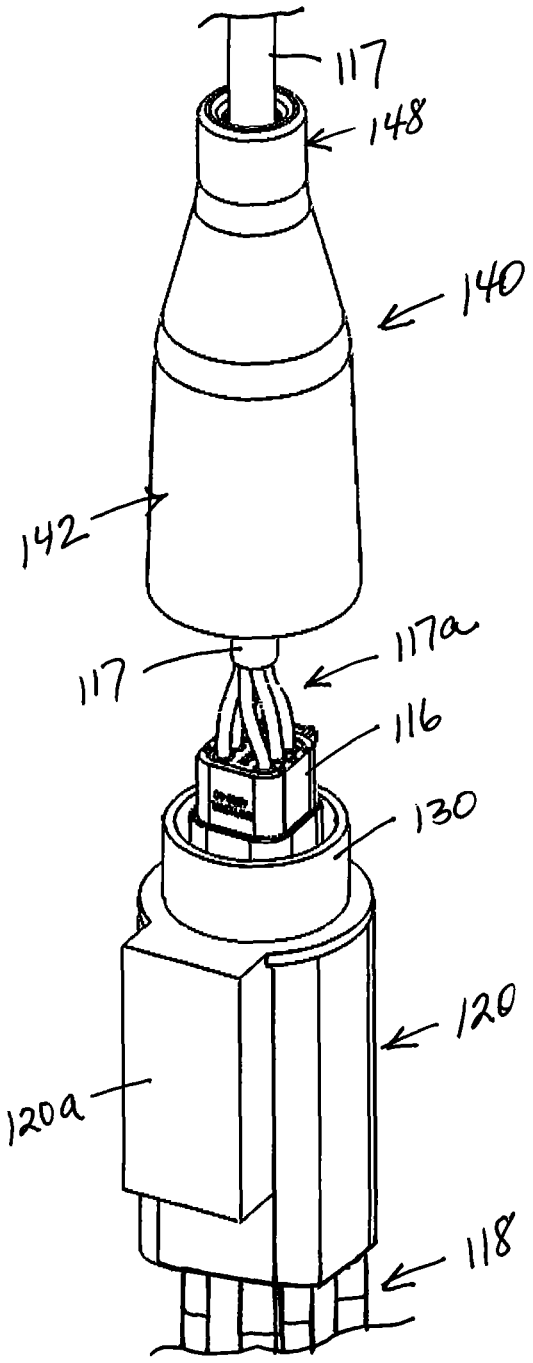
FIG. 15 is a partially exploded perspective view of the embodiment shown in FIG. 12.
Figure 16:
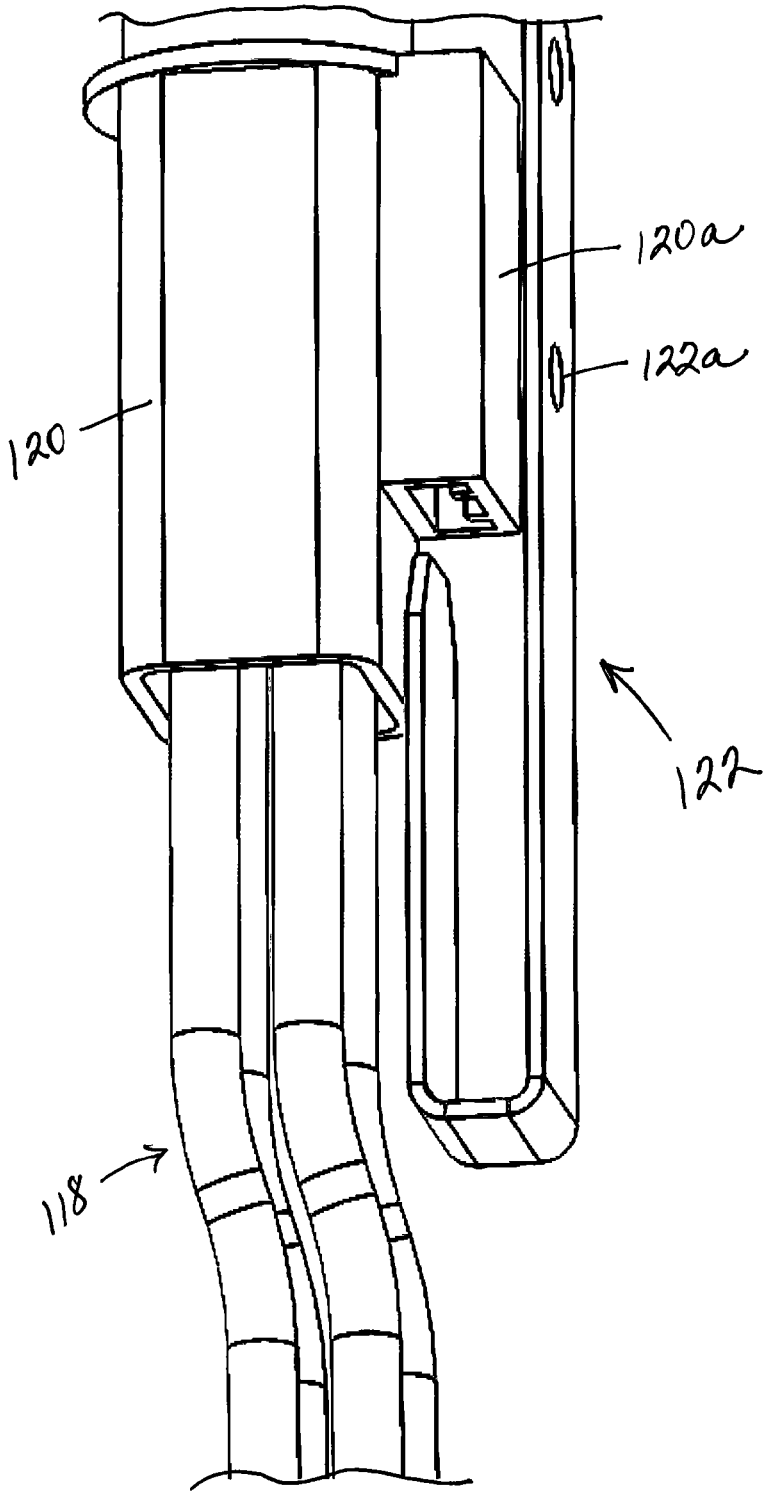
FIG. 16 is a bottom perspective view of a portion of the embodiment shown in FIG. 12.

As illustrated in FIGS. 13 and 15 of the drawings, the first seal member 130 is connected to the base 120. The first seal member 130 may be a separate component attached to the base 120 or integrally formed with the base 120 as a unitary structure. The first seal member 130 preferably extends upwardly from a bottom surface of the base 120 to further protect the first connector 114 and the second connector 116 since gravity will pull any contaminants such as liquids and debris that get between the seal members 130, 140 downwardly away from the connectors 114, 116.

The first seal member 130 is preferably comprised of a tubular structure that surrounds the first connector 114. The first seal member 130 preferably has a circular cross sectional shape as illustrated in FIGS. 13 and 15 of the drawings, however, the first seal member 130 may have various other cross sectional shapes such as but not limited to rectangular. The first seal member 130 has a lower opening that exposes the corresponding first connector 114 within the first seal member 130.

The second seal member 140 physically connects to the first seal member 130 to prevent the entry of contaminants such as liquids and debris and prevent contact with the first connector 114 and second connector 116 when the connectors 114, 116 are connected to one another. The second seal member 140 is formed into a shape that mates with the first seal member 130 to prevent the entry of contaminants such as liquids and debris from making contact with the connectors 114, 116 when positioned within a wet environment such as within a septic tank. The first seal member 130 and the second seal member 140 each cover and/or seal a respective pair of connectors 114, 116 to protect the connectors 114, 116 from contaminants such as liquids and debris.

Figure 12:
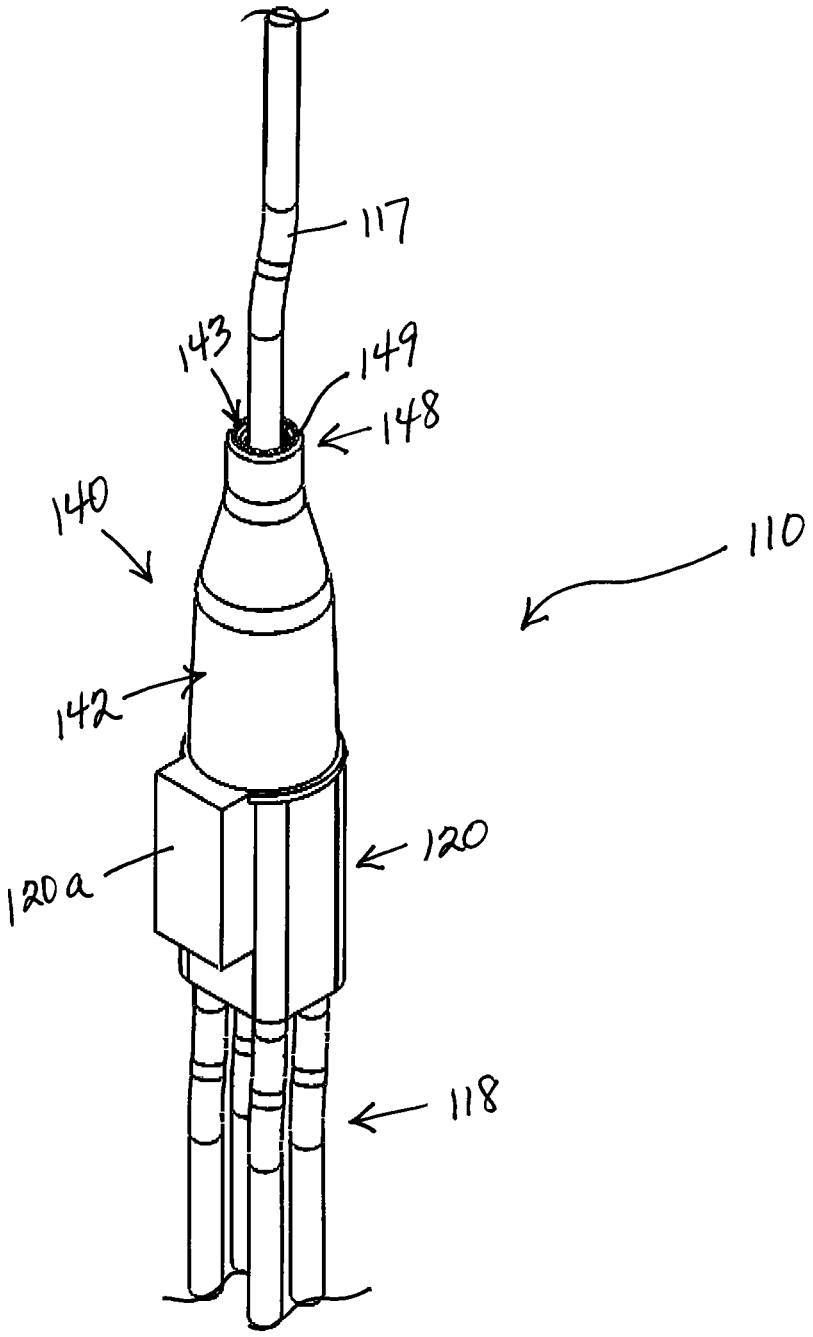
FIG. 12 is an upper perspective view of another embodiment of the present invention.

The first seal member 130 and the second seal member 140 preferably overlap one another to form a protective seal that prevents contaminants such as liquids and debris from contacting the connectors 114, 116. It is preferable that the second seal member 140 overlaps the first seal member 130 as illustrated in FIG. 12 of the drawings. The second seal member 140 preferably overlaps an entire portion of the first seal member 130.

The second seal member 140 is comprised of a tubular structure having a first opening 144 in a first end that fits over the first seal member 130. Alternatively, the first seal member 130 can be sized larger than the second seal member 140 to fit over the second seal member 140. The second seal member 140 also has a second opening 149 in a second end that receives a cable 117. The second end of the second seal member 140 is opposite of the first end, with the first opening 144 preferably concentrically aligned with the second opening 149 of the second seal member 140.

Figure 14:
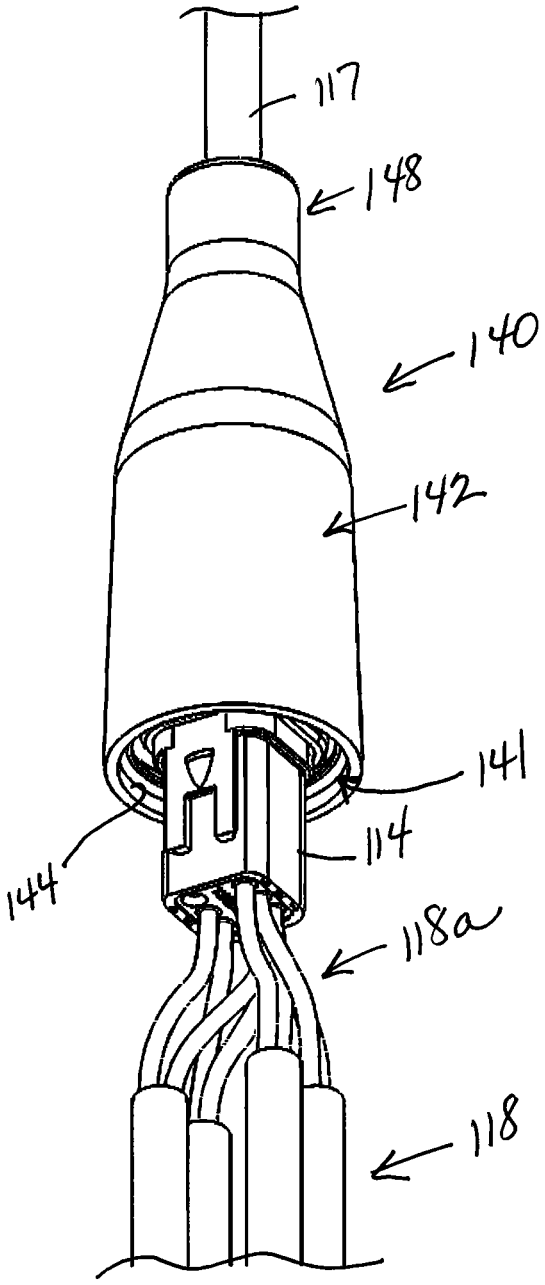
FIG. 14 is a partially exploded perspective view of the embodiment shown in FIG. 12.

The second seal member 140 is preferably comprised of a resilient and flexible material that allows for a snug fit over the first seal member 130. The second seal member 140 is preferably comprised of a first portion 142 encompassing the first opening 144 and a second portion 148 encompassing the second opening 149, wherein the second portion 148 is narrower than the first portion 142. The first portion 142 has a first interior portion 141 that is large enough to receive the outer surface of the first seal member 130 as illustrated in FIG. 14 of the drawings. The first interior portion 141 has an interior surface that is preferably comprised of a constant diameter that is approximately the same as the outer diameter of the first seal member 130. The second portion 148 of the second seal member 140 could optionally include a flanged portion (not shown) surrounding the second opening 149. The second opening 149 is adapted to allow the cable 117 positioned within the second opening 149 to slide longitudinally within the second opening 149 while having an interior diameter sufficient to provide a liquid tight seal against the entry of contaminants such as liquids and debris into the interior of the second seal member 140.

The cables 118 are electrically connected to the cable 117 within the second seal member 140 via the connectors 114, 116. The second seal member 140 could optionally include a gripping surface (not shown) on the exterior of the first portion 142 to assist in manipulation by the user such as but not limited to a plurality of raised rings.

In use, the user mounts the control panel externally of the tank in a desired location and then secures the base 120 to the wall of the tank above the highest possible liquid level within the tank. The user then electrically connects the cable 117 from the control panel by connecting the second connector 116 with the first connector 114. The user then slides the primary second seal member 140 downwardly along the cable 117 and then onto the first seal member 130 until snugly and frictionally retained upon the first seal member 130. Once the connectors 114, 116 are connected and their corresponding seal members 130, 140 are connected together in a liquid sealed or semi-sealed manner, the user may then operate the tank by allowing liquid such as water to enter the tank. The electronic device(s) provide data to the control panel via the cables 118 and then to the control panel by the primary cable 117. Contaminants such as water, other liquids, and debris that may engage the second seal member 140 are deflected and allowed to freely fall off. Any contaminants that should enter between the seal members 130, 140 is allowed to flow downwardly without contacting the connectors 114, 116. The second seal member 140 in particular deflects debris such as toilet paper to prevent the same from attaching to the connectors 114, 116 which can over time reduce the water tight seal the connectors 114, 116 have created with respect to one another after connection thereby extending the useful life of the connectors 114, 116.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An electrical junction system, comprising:

a base;

at least one first seal member connected to said base;

at least one first connector respectively positioned within said at least one first seal member;

at least one second connector respectively electrically connectable to said at least one first connector and when electrically connected each forms a pair of first and second connectors, each said pair of first and second connectors adapted to be sealed to form a first seal;

at least one second seal member being slidably operatively connected to at least one second connector and corresponding with said at least one first seal member and configured and arranged to respectively operatively connect to said first seal member to form a second seal adapted to prevent the entry of a contaminant into said first and second seal members proximate said first seal; and wherein each of said first seal and said second seal protects said pair of first and second connectors.

2. The electrical junction system of claim 1, wherein said at least one first connector is comprised of a primary first connector and at least one secondary first connector, wherein said primary first connector is electrically connected to said at least one secondary first connector.

3. The electrical junction system of claim 2, wherein said at least one second connector is comprised of a primary second connector that is electrically connected to said primary first connector and at least one secondary second connector, wherein said at least one secondary second connector is electrically connected to an electronic device.

4. The electrical junction system of claim 3, wherein said electronic device is comprised of a float switch.

5. The electrical junction system of claim 2, wherein said primary second connector is electrically connected to a control panel.

6. The electrical junction system of claim 1, including a liquid tank, wherein said base is attached to an interior wall of said liquid tank.

7. The electrical junction system of claim 6, wherein said liquid tank is comprised of a septic tank.

8. The electrical junction system of claim 1, wherein each of said at least one first seal member and respectively each of said at least one second seal member overlap one another to form said second seal.

9. The electrical junction system of claim 1, wherein each of said at least one second seal member overlaps respectively each of said at least one first seal member to form said second seal.

10. The electrical junction system of claim 9, wherein each of said at least one second seal member overlaps an entire portion of respectively each of said at least one first seal member.

11. The electrical junction system of claim 10, wherein said at least one first seal member extends outwardly from a bottom surface of said base.

12. The electrical junction system of claim 11, wherein said at least one second seal member is comprised of a tubular structure, wherein said at least one second seal member has a first opening in a first end that fits over said at least one first seal member.

13. The electrical junction system of claim 12, wherein said at least one second seal member has a second opening in a second end that receives a cable.

14. The electrical junction system of claim 13, wherein said at least one second seal member is comprised of a first portion encompassing said first opening and a second portion encompassing said second opening, wherein said second portion is narrower than said first portion.

15. The electrical junction system of claim 14, wherein said second portion includes a flanged portion surrounding said second opening.

16. The electrical junction system of claim 12, wherein said at least one second seal member is comprised of a resilient and flexible material.

17. The electrical junction system of claim 13, wherein said second opening for each of said at least one second seal member is adapted to allow said cable positioned within said second opening to slide longitudinally within said second opening.

18. The electrical junction system of claim 1, further comprising at least one housing respectively adapted to receive each of said pair of first and second connectors.

19. The electrical junction system of claim 18, further comprising a housing stop extending outward from each of said at least one housing and adapted to connect each of said pair of first and second connectors.

20. The electrical junction system of claim 19, wherein each of said at least one second connector is respectively operatively connected to said at least one housing and said housing stop assists in operatively connecting each of said at least one first connector respectively to each of said at least one second connector.

21. The electrical junction system of claim 20, wherein said at least one housing and said at least one second connector are potted.

22. An electrical junction system, comprising:

a base;

a primary cable attached to said base;

a first seal member connected to said base;

a first connector electrically connected to said primary cable;

a second connector electrically connectable to said first connector and when electrically connected forms a pair of first and second connectors, said first and second connectors adapted to be sealed to form a first seal;

at least one secondary cable, the at least one secondary cable being connected to said at least one second connector;

a second seal member slidably connected to one of said at least one secondary cable and configured and arranged to operatively connect to said first seal member to form a second seal adapted to prevent the entry of a contaminant into said first and second seal members and proximate said first seal; and wherein each of said first seal and said second seal assist in protecting said pair of first and second connectors.

23. The electrical junction system of claim 22, further comprising a housing adapted to receive said pair of first and second connectors.

24. The electrical junction system of claim 23, further comprising a housing stop extending outward from said housing and adapted to connect said pair of first and second connectors.

25. The electrical junction system of claim 24, wherein said second connector is operatively connected to said housing and said housing stop assists in operatively connecting said first connector to said second connector.

26. The electrical junction system of claim 25, wherein said housing and said second connector are potted.

* * * * *